US005256000A

United States Patent [19]

Beamer

[11] Patent Number: 5,256,000

[45] Date of Patent: Oct. 26, 1993

[54] APPARATUS FOR FORMING A MULTI-WALLED TRENCH

[75] Inventor: John V. Beamer, Atlanta, Ga.

[73] Assignee: Construction Casting Company, Atlanta, Ga.

[21] Appl. No.: 931,151

[22] Filed: Aug. 17, 1992

[51] Int. Cl.[5] ..... E02B 5/00

[52] U.S. Cl. ..... 405/119; 404/2; 405/121

[58] Field of Search ..... 405/118-122, 405/36, 43, 52, 45; 404/2-4, 26

[56] References Cited

U.S. PATENT DOCUMENTS

| | | | |
|---|---|---|---|
| 786,305 | 4/1905 | McIntyre | 249/11 |
| 1,473,551 | 11/1923 | Gschwind . | |
| 1,562,780 | 11/1925 | Nickelson | 249/11 |
| 2,938,437 | 5/1960 | Daley . | |
| 3,299,785 | 1/1967 | James . | |
| 3,362,167 | 1/1968 | Ward . | |
| 3,625,011 | 7/1971 | Stevenson . | |
| 4,472,078 | 9/1984 | Karbstein | 404/2 |
| 4,840,515 | 6/1989 | Freese | 405/45 |
| 4,844,655 | 7/1989 | Aleshire | 405/118 |
| 4,878,782 | 11/1989 | Beattie et al. | 405/119 |
| 4,968,179 | 11/1990 | Frahm | 405/52 X |
| 4,993,877 | 2/1991 | Beamer | 405/282 |
| 4,993,878 | 2/1991 | Beamer | 405/282 |
| 5,000,621 | 3/1991 | Beamer | 405/118 X |

*Primary Examiner*—Dennis L. Taylor

*Attorney, Agent, or Firm*—Needle & Rosenberg

[57] ABSTRACT

A system for forming a multi-walled trench comprising a pair of frame members, each having a horizontal section and a section depending from the horizontal section; a holding pan having sidewalls exterior to the depending portion of the frame members, a bottom floor disposed between the sidewalls, and flanges on each sidewall extending parallel to the plane of the horizontal section of the frame member and away from the depending portion; an outer wall disposed within the holding pan having an inside surface and an outside surface, the outside surface of the outer wall engaging at least a portion of the sidewalls and the bottom walls of the holding pan; an inner wall disposed within the outer wall having an inside surface and an outside surface, the inside surface of the inner wall engaging at least a portion of the inner surface of the depending portion of the frame members, and a cavity being formed between the outside surface of the inner wall and the inside surface of the outer wall; means in the cavity for separating the inner wall from the outer wall to allow the expansion and contraction of each wall relative to the other; means for adjustably securing each frame member to a respective one of the flanges on a sidewall whereby the inner and outer walls are maintained in their desired locations within the pan; and adjustable anchoring means attached to the frame members for providing vertical adjustment of the frame members relative to the ground and to each other.

17 Claims, 8 Drawing Sheets

APPARATUS FOR FORMING A MULTI-WALLED TRENCH

BACKGROUND OF THE INVENTION

The present invention relates to the construction industry, and more specifically to the formation of a pre-engineered grate or covered multi-walled trench including an assembly for forming the trench and a frame for the assembly. The need for a multiple walled containment trench with frames has evolved with the need to prevent seepage of objectional materials through the trench walls and into the surrounding ground.

The need for this invention has resulted from Federal Regulations, particularly from the E.P.A. For instance, underground tanks used for fuel or other chemicals must have a tank inside a tank. Should a leak occur in the inner holding tank the fluid would be captured by the outer tank feeding to a low point leak sensor or feeding to a strip sensor along the bottom of the outer tank such as one made by Rachem Corp., setting off an alarm that leakage had occurred. It is expected that similar regulations may be forthcoming for trenches containing certain liquids, therefore the need exists for multi-walled trenches which allow for leak detection.

The general concept of trench drainage systems has long been used. Trenches are used where liquid run-offs occur, such as in chemical plants, food processing operation, pulp and paper mills, pharmaceutical manufacturing, bottling plants, in parking garages and parking areas of shopping centers. The fluid from a trench generally goes into a catch basin or sewer large enough to release the material from the trench as it arrives. The top of the trench is normally covered with a slotted grate to allow entrance of the fluids, catching of debris, load carrying capacity for whatever may pass over it, and made of a material that will withstand the corrosiveness of the fluid entering the trench. In some applications the top of the trench may be solidly covered, such as crossing sidewalks or where conduits are carried within the trench and fluid entry is minimal and not necessarily desirable.

Minimal development has been done in the field of double containment trenches with frames to support grates and covers. In the prior art, a double walled polymer concrete channel has been made. These channels were constructed in relatively short lengths, requiring many joints where leaks could occur. Another problem existed in that heavy traffic would also frequently pass over the trenches. In the prior art, proper protection of the inner and outer trench, or liner, was not provided. Thus, failure of the trench or liner could easily occur, causing leakage.

Another disadvantage in the prior art exists in the lack of provisions for replacement of the frame, the inner trench liner, or outer trench liner without having to essentially remove the old system and install a new one at an extremely high expense. Furthermore, the inner and outer walls of these containment trenches were attached to each other, thus allowing no independent contraction or expansion of either wall, resulting in buckling and failure of the containment system.

In the prior art, either trenches have no slope or a fixed slope. Thus, the engineer can not design the trench to his requirements but must use what comes off the shelf, thus limiting his options. In the prior art, limited widths and depths have been offered. Therefore the fluid flow was restricted to the available trenches, instead of trenches being designed for the fluid flow.

Therefore, there exists a need for a double containment trench system which will provide a minimum number of joints to reduce possible leakage points.

There exists a need for a double containment trench system that can accommodate a variety of temperatures over a wide range without rupturing the liners or breaking the joints apart from either heat, cold, expansion or contraction.

There exists a need for a double containment system that offers an extra protection against leaks at the joints of the trench.

There exists a need for a double containment system that offers protection to the inner and outer liner from heavy traffic passing across the trench.

There exists a need for long length trenches with virtually no joints.

There exists a need for a cost effective method of replacing the frame, the inner trench liner, or outer trench liner should a leak occur or the liner or the frame begin to wear out.

SUMMARY OF THE INVENTION

The disadvantages of the prior art are overcome by the present invention which relates to a grate-covered multiple wall containment trench.

A pair of adjustable frames for maintaining a grate in a stable position along the trench are provided. The frame design is essentially the same as in U.S. Pat. Nos. 5,000,621 and 4,993,878 except that the slots in the frame are substituted with a bolt on the bottom of the Z frame bearing surface. The grate bearing surface is extended an additional length equal to the combined trench wall thickness in order to insure adequate bearing surface with the concrete. An additional feature may include a secondary bearing surface to which the Z-shaped frame may be attached and detached for replacing the frame or the trench inner and outer walls.

Each of the frames include adjustable anchoring means for adjusting the trench system up and down to the surface elevation prior to the pouring of concrete. The anchoring means include a tubular collar which has an opening through which a supporting rod may pass. It is preferred that the anchoring means appear at each opposite end of the above described frames, although addition of such anchoring means may be provided in between the ends of relatively long frames. Each collar has a threaded bore through which a correspondingly threaded L-bolt may be placed for securing the collar and hence the frame and trench system in position along the rod. Multiple bores and corresponding L-bolts may also be placed in each collar to enhance securing the position of the collar along the rod.

The trench containment unit comprises: a holding pan or trench wall containing means which is encased by the concrete and a first or outer wall and a trough or inner wall through which the fluids actually flow. For additional containment protection, additional walls can be further disposed within the inner wall.

The holding pan will be attached securely to the frames and generally consists of materials such as galvanized steel, stainless steel or other firm materials or plastics which will not expand or contract significantly so as to buckle when encased in concrete. This pan will be attached by bolts to the bottom of the frame members through a flange at the top of the holding pan. The holding pan is attached to the frame through round and/or slotted holes fitting over threaded bolts. The unthreaded slots or holes are larger than the bolts so as to accommodate any expansion and contraction of the walls without tearing them from the bolts.

The inner and outer walls can be made of metals, thick or thin, galvanized, painted or coated, as well as different plastics, fiberglass or other suitable materials of varying thicknesses depending upon the fluids that will come in contact with the inner surfaces of the walls. The inner and outer walls will expand and contract due to the varied temperatures of the fluid and the temperatures surrounding the trench system. In some instances, this does not create a problem as long as the walls and the surrounding material expand and contract at nearly the same rate. In many installations, this is not the case where expansion and contraction can rupture the walls during significant changes in temperature of the fluids in the trench. Therefore, the inner and outer walls are mounted within the pan so that they are each allowed to expand or contract individually depending upon the temperature and composition of each, which could vary a significant amount.

Means are provided within the cavity formed between the inner and outer walls to evenly space the walls from each other along their lengths. The spacing means is a plurality of spaced rigid elements or projections from the outside surface of the inner wall to the inside surface of the outer wall. Spacing of the projections and distance between walls must be adequate for fluid flow and to accommodate sensors at any point in the trench which may include sensors along the entire length of the trench.

The trench containment unit is extremely flexible in allowing continuous walls with no expansion joints for one hundred feet or more with a sloping or neutral bottom as required. The trench containment unit should be an unbroken unit as long as possible to minimize the number of joints which might leak. The inner wall can be neutral or sloping as needed. The walls will normally be secured in the pans in such a manner that they will expand from the shallow end toward the deeper discharge end. Where long trenches occur, there will be expansion of the trench walls beyond the length of the frames. This expansion must be unimpeded but accommodations for added length, turns and intersections is needed. The use of a standard lap joint filled with flexible sealants will work in many instances but for more complete safety, double containment junction boxes will be necessary. The in-flow end of the walls into the junction box will allow for expansion and contraction while the out-flow portion of the walls will be anchored solidly to the junction boxes allowing the walls to expand along its length to the next junction box.

The junction box is an open topped box with a frame to support a grate or cover. The junction box may be constructed with an inner and outer wall, and a sensor may be placed between the walls for leak detection, if desired. In some of the systems, it is possible to check visually for leaks between the inner and outer walls which is preferred since it is possible a sensor may fail.

To form the containment trench with a frame, an elongated trench is dug larger than the trench unit to be installed therein. The exterior holding pan is placed on temporary blocks which approximate the thickness of the concrete or other material to be placed therein. The outer wall is then placed inside the pan. A sensor may be installed at a low point along the outer wall or continuously along the bottom in cable form.

The inner wall will then be placed within the outer wall so that the top edges of both walls are level A T-shaped spacer is then placed along the top edges and into the cavity to hold the inner and outer walls the proper distance apart. The spacer also provides a cap over the walls discouraging materials from entering the cavity. A flexible sealant, such as D Aircraft Products - BR 4005, should be placed along both sides of the T-shaped spacer where it is in contact with the outer and inner walls.

A flexible sealant is then put on the backside of the Z-frame which will fit against the inner wall. The frames are attached to the holding pan by inserting the frame bolts through the slots in each of the flanges of the pan which are secured by washers and nuts. The pan is then pushed toward the frame until the outer and inner walls fit snugly against the frame but are still loose enough to expand or contract. The nuts on the pan bolts are then tightened down snugly. The trench system is then raised in place to the proper height on the anchor stands through which supporting rods have been driven into the subsurface and tightened in place ready for concrete or other material to be poured around the walls.

The inner and outer walls and holding walls are anchored at the shallow end of the trench. At the discharge end of the trench, maximum expansion or contraction will occur. At the discharge end of each trench, an expansion joint or a junction box with continuing discharge capabilities will be needed to extend the trench to its desired length. Intersections may also require similar junction boxes or expansion joints.

At the top outside of the frame, after the concrete or other material has been poured and just before it hardens, it is recommended that a vertical groove be formed with a trowel. This indentation may be filled with caulking or the coating covering the adjacent flooring thus improving the seal at the frame. The grates or covers can then be placed in the frames.

It can be seen, therefore, that it is the object of the present invention, to provide an improved multiple walled containment trench.

It is also an object of the present invention to provide a pre-engineered dual containment trench with frames.

It is also an object of the present invention to produce a neutral or sloped trench as required.

It is also an object of the present invention to provide a double containment trench with variable slope abilities.

It is also an object of the present invention to produce a complex trench system at a reasonable cost.

It is also an object of the present invention to provide a modular system which is easy to install.

It is also an object of the present invention to provide a low cost unit which is effective to install, yet easy to produce.

It is also an object of the present invention to provide a junction box which will allow for intersections or much longer continuous trenches and to accept the expansion and contraction of very long trenches.

It is also an object of this invention to construct an outside trench wall that will accommodate expansion and contraction and an inside wall also capable of expanding or contracting at the same or different rate as the outside wall, without rupturing because of expansion or contraction.

It is also an object of this invention to provide a holding pan which may also serve as the outer wall of a double containment trench.

It is also an object of this invention to provide a holding pan which may become the outer wall of a triple or more walled containment trench.

It is also an object to make a long double containment trench system, minimizing the number of joints.

Another object of the present invention is to seal, without tying, the inner and outer walls together by using a combination of a plug spacer and sealants placed at the top of and between the walls.

It is also an object of the present invention to provide a means of holding the inner walls apart from each other allowing for leak sensor placement.

It is also an object of the present invention to provide a double containment trench system with frames which allows the frame, and/or inner or outer wall to be replaced without tearing out the trench.

It is a further object of the present invention to provide a frame designed to carry the heaviest loads yet protect the trench walls below.

It is a further object of the present invention to provide a double containment trench so constructed that heavy equipment can pass over it without damaging the walls.

It is still a further object of the present invention to provide a method of suspending the trench system while concrete or other materials are put around the trench.

DETAILED DESCRIPTION OF THE PREFERRED EMBODIMENTS

Figure 1:
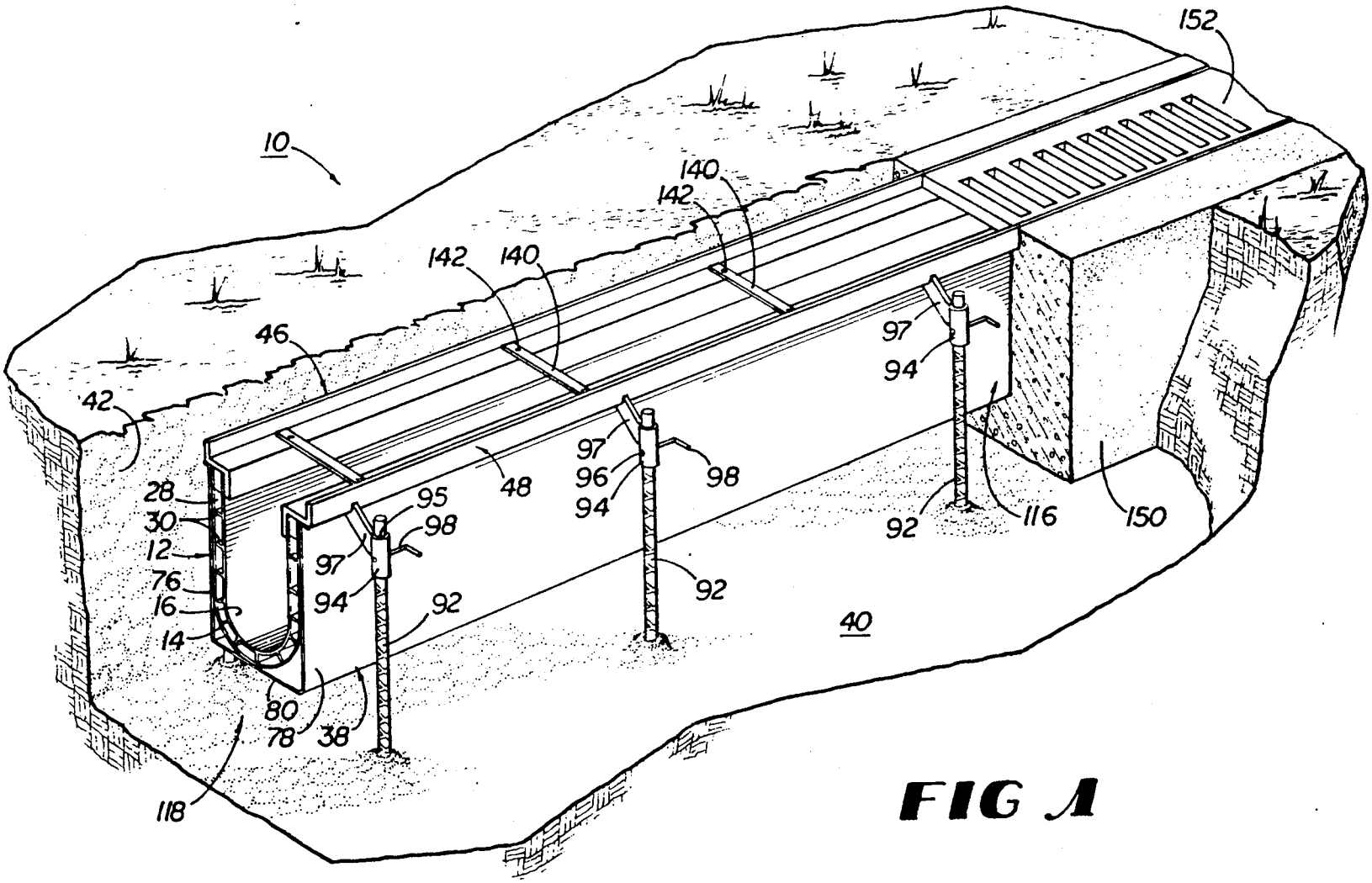
FIG. 1 is a perspective view of a trench assembly of the present invention having a multi-walled design.

Referring to FIG. 1, the multi-walled trench 10 of the present invention is shown comprising an outer wall 14, an inner wall 16 resting inside the outer wall 14, and a cavity 28 maintained between the inner wall 16 and the outer wall 14. Also shown and described hereinafter are means for anchoring the system to the ground and means for interconnecting the multi-walled trenches. The inner wall 16 is not attached to the outer wall 14, allowing the inner wall 16 and outer wall 14 to expand and contract along their lengths independently from each other, and also allowing for the easy removal and replacement of the frame 46, inner wall 16 and/or the outer wall 14.

Figure 7:
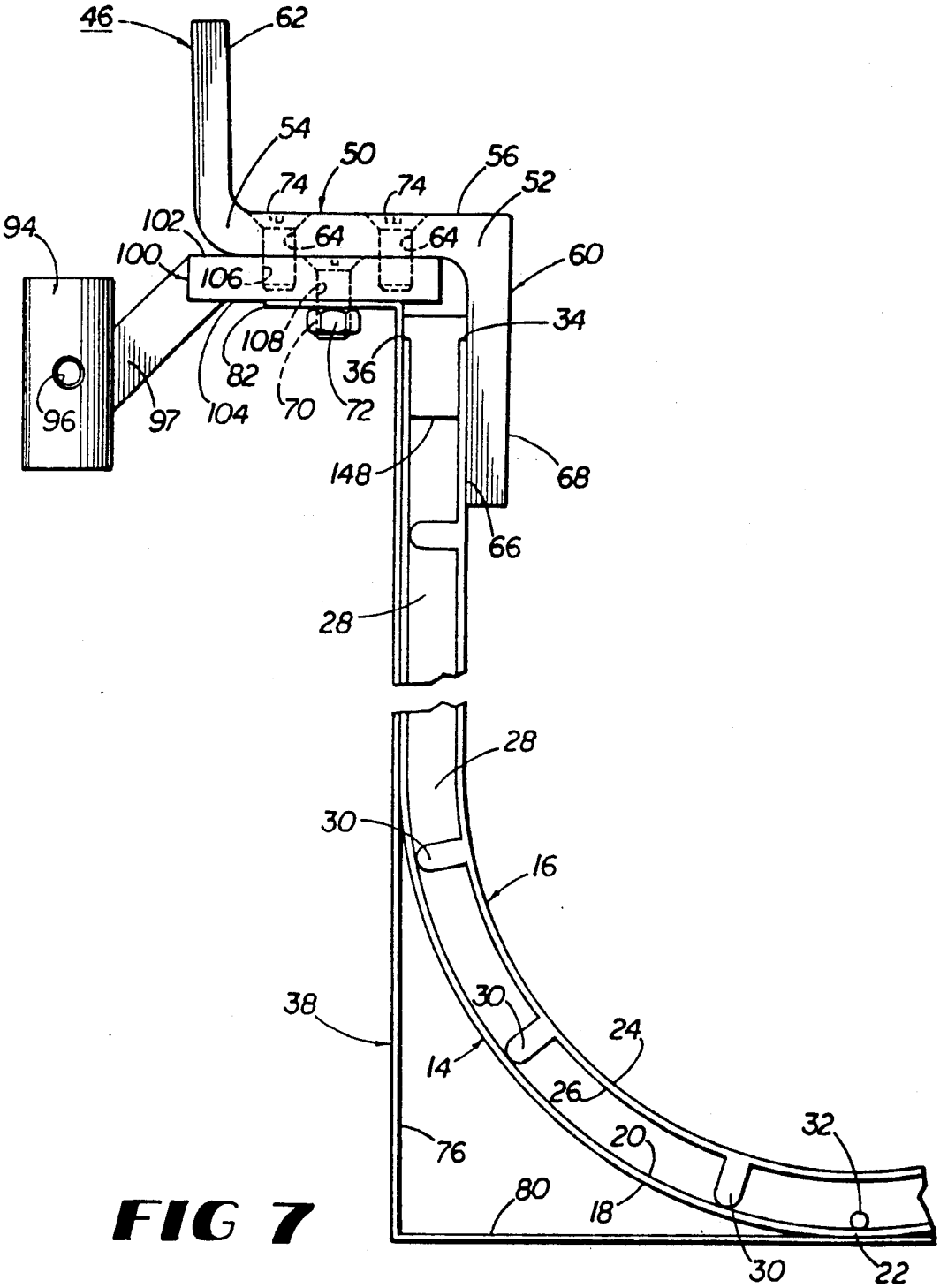
FIG. 7 is a partial cross-sectional view of the dual containment trench in accord with the present invention.
Figure 8:
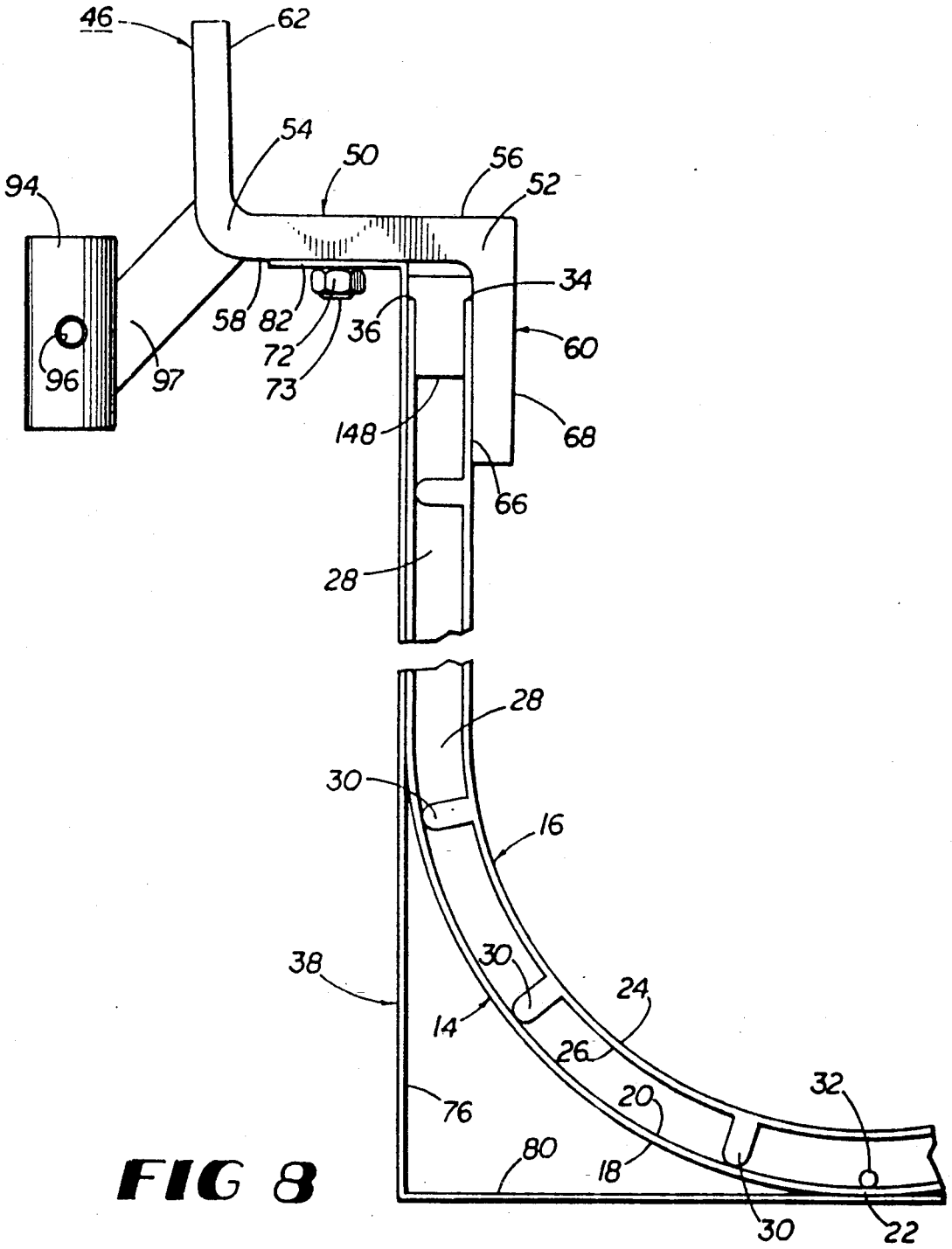
FIG. 8 is a cross-sectional view of an alternative embodiment of the dual containment trench shown in FIG. 7.

As shown in FIGS. 1, 7, and 8, the outer wall 14 will generally be made in a rectangular or "U" shape, and will be large enough that its total cross-sectional width, defined by the outside surface 18, will be substantially the same as the width of the holding pan 38 described below, and capable of fitting therein. The inner wall 16 also has a rectangular or "U" shape. A plurality of rigid, outwardly projecting spacing members 30 are, at one end, affixed to and spaced along the outside surface 26 of the inner wall 16 and extend to and engage the inside surface 20 of the outer wall 14. Of course, these spacing members 30 can be attached to the inside surface 20 of the outer wall 14. The inner wall 16 will have a cross-section similar to, but smaller in cross-sectional dimension than the outer wall 14 in order to fit within the outer wall 14.

The inner wall 16 and the outer wall 14 can be molded, formed, or extruded easily from a variety of rigid materials, such as stainless steel, galvanized or coated steel, aluminum, fiberglass, or a plastic compound. The choice of material for each trench depends on the properties of the liquids expected to be captured in the trench system.

Referring to FIGS. 1, 7, and 8, the spacing members 30 are of uniform length to provide secure seating of the inner wall 16, and are separated from each other along the outside surface 26 to provide overall support. The spacing members 30 are also arranged along the inside surface 20 of the outer wall 14 so that they do not interfere with any fluid leak sensors 32 which may be placed in the bottom 22 of the outer wall 14. The spacing members 30 can have a variety of cross-sections.

Figure 2:
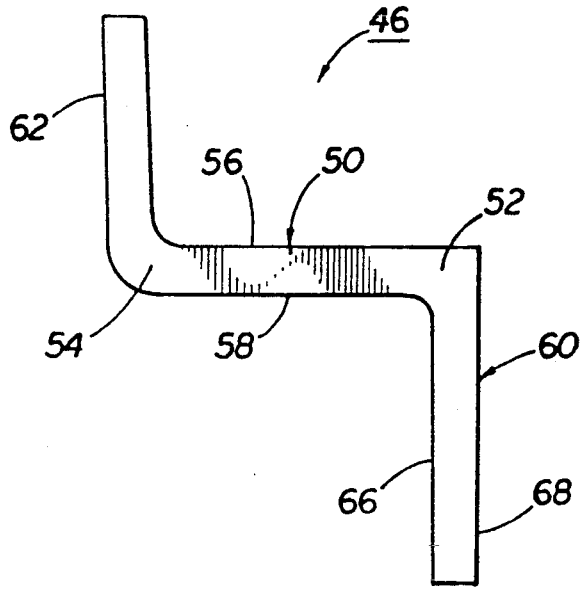
FIG. 2 is a cross-sectional view of the frame member in accord with the present invention.
Figure 3:
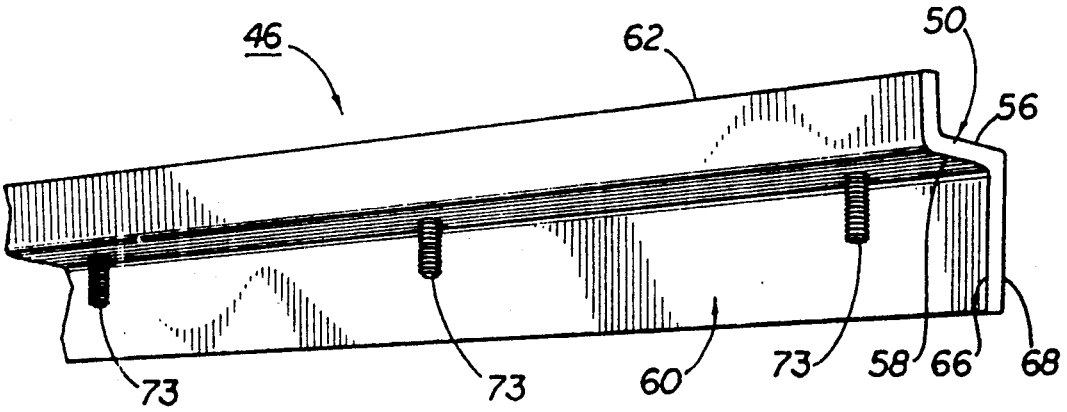
FIG. 3 is a perspective view of an embodiment of the frame in accord with the present invention.
Figure 4:
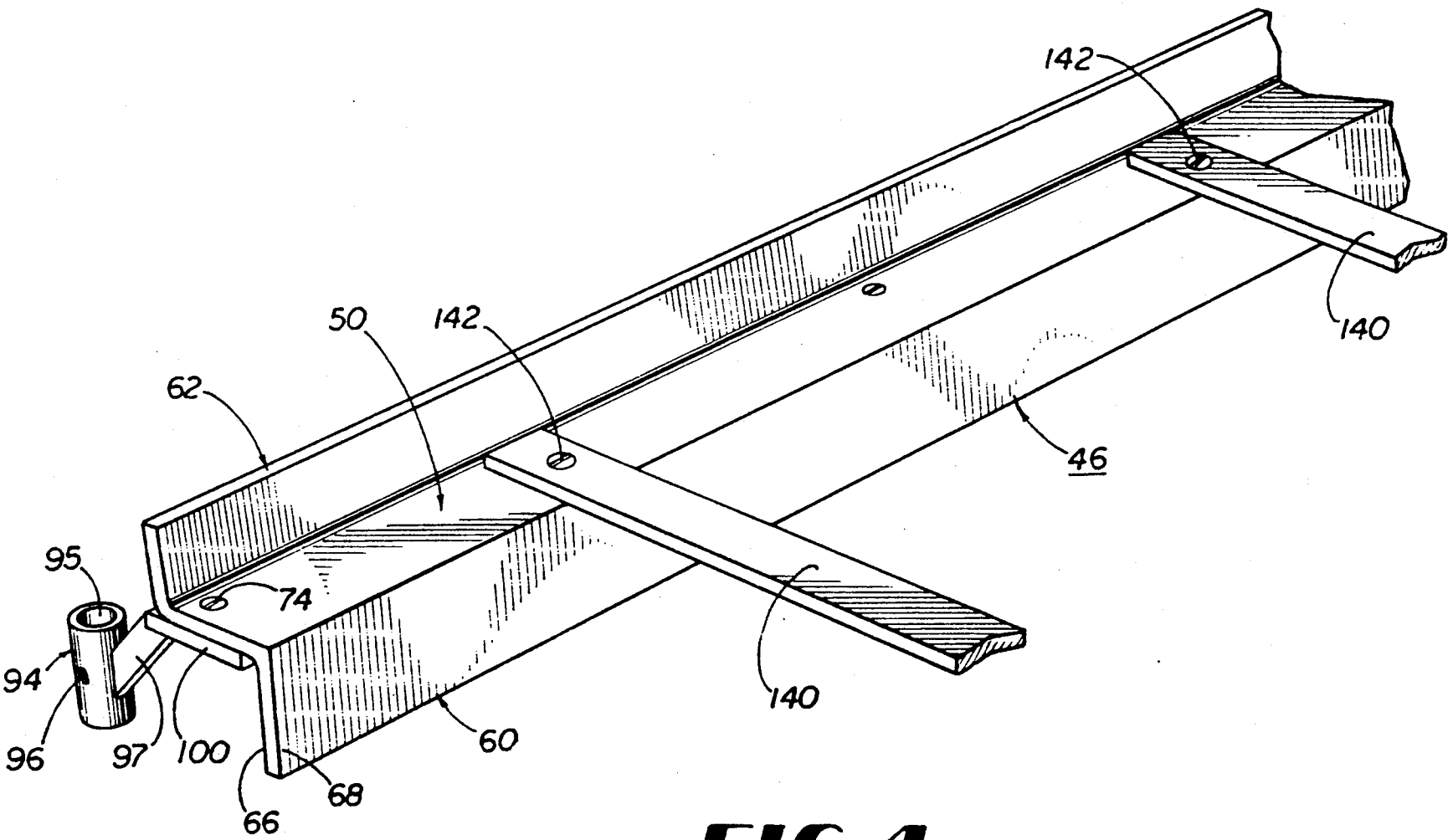
FIG. 4 is a perspective view of an embodiment of the frame in accord with the present invention.

Referring to FIGS. 2, 3, and 4, the frame members 46, 48 typically have a "Z" shape in cross-section, with a central, horizontal section 50, a depending portion 60 joined to the forward edge 52 of the horizontal section 50, and a grate contacting member 62 ascending from the rearward edge 54 of the horizontal section 50.

Referring to FIG. 7, each frame member 46, 48 has a plurality of bolt holes 64 in the horizontal section 50. In the preferred embodiment, through each of these bolt holes 64, a threaded bolt 74 will pass to secure the frame member 46, 48 to anchor plate 100, and another bolt 70 will pass through both the second bolt hole 108 in the anchor plate 100 (described below) and the flange adjustment slot (not shown), secured by nut 72 as shown in FIG. 7. In the alternative embodiment, as shown in FIG. 8, a bolt 73, welded directly to surface 58 of the frame 46, 48, passes through the flange adjustment slot (not shown) and is secured by nut 72 (only the left flange is shown in FIGS. 7 and 8). Each frame member 46, 48 is made of a rigid material which preferably can be molded, formed, or extruded easily into the desired frame shape. Examples of materials include stainless steel, galvanized or coated steel, aluminum, fiberglass, or a plastic composition.

The holding pan 38, shown in FIGS. 1, 7, and 8, comprises a pair of upstanding sidewalls 76, 78 and a bottom floor 80 disposed between the sidewalls 76, 78. The holding pan contains the inner wall 16 and outer wall 14. Flanges 82 (only the left flange is shown in FIGS. 7 and 8) laterally extend from the top edge of the respective sidewalls 76, 78 away from the center of the holding pan 38. The sidewalls 76, 78, bottom floor 80, and flanges 82 will usually be at right angles to each other, but it will be obvious that this particular shape is merely one of convenience. Spaced along each flange 82 is a plurality of adjustment slots (not shown) therethrough. In the preferred embodiment, these flange adjustment slots align with the second bolt holes 108 in the anchor plate 100 (described below); in the alternative embodiment, the flange adjustment slots align directly with the frame bolt holes 64. The holding pan 38, like the frame members 46, 48, can be cast, formed, or extruded easily from a variety of rigid materials, such as stainless steel, galvanized or coated steel, aluminum, fiberglass, or a plastic composition.

Figure 5:
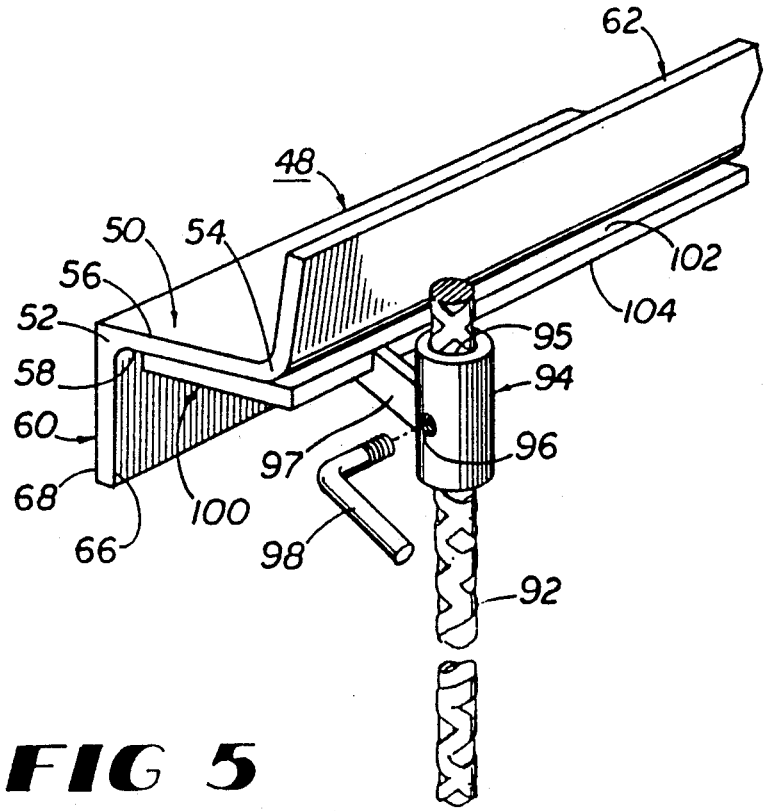
FIG. 5 is a perspective view of the anchor stand and frame for the embodiment shown in FIG. 4.
Figure 6:
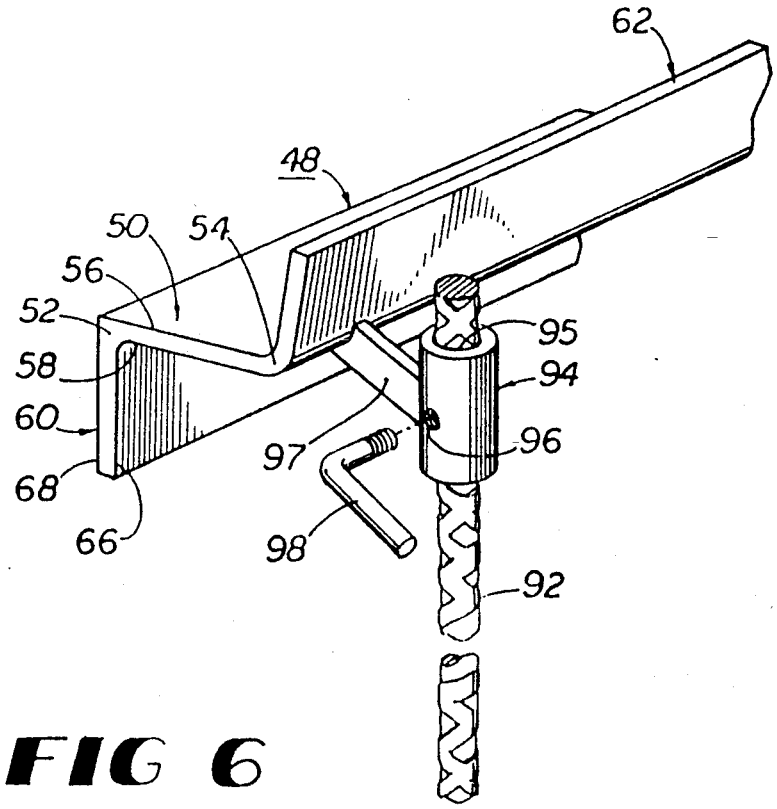
FIG. 6 is a perspective view of the anchor stand and frame for an alternative embodiment of the embodiment shown in FIG. 4.

Referring to FIGS. 5 and 6, the preferred ground anchoring means comprises a supporting rod 92, a cylindrical collar 94 having a threaded bore 96 laterally extending therethrough and a longitudinally extending opening 95 for receiving the supporting rod 92, an L-bolt 98 which is threaded to match the threaded bore 96, a connecting member 97 attached to the collar 94, and an anchor plate 100 to which both the frame member 46, 48 and the flanges 82 will be attached. It is obvious that the rod 92, the collar 94, and its axial opening 95 need not be cylindrical in shape. FIGS. 5 and 7 show the collar 94, the connecting member 97, and the anchor plate 100 as being integrally formed as a single piece (and likewise FIGS. 6 and 8 show the collar 94, the connecting member 97, and the frame 46, 48 as being integrally formed as a single piece), but this is not the only connecting means.

The anchor plate 100 will have a plurality of vertically extending threaded bolt holes 106 and unthreaded bolt holes 108, spaced along the anchor plate 100, which can be distinguished into two types: the first bolt holes 106 will be used to secure the frame 46, 48 to the anchor plate 100, while the second bolt holes 108 will be used to secure the flange 82 to the anchor plate 100. The first bolt holes 106 are spaced along the anchor plate 100 so that they will align with the frame bolt holes 64. The second bolt holes 108 are spaced along the anchor plate 100 so that they will align with the flange adjustment slots. As shown in FIG. 8, as an alternative embodiment, the connecting member 97 can instead be attached directly to the frame member 46, 48.

Figure 9A:
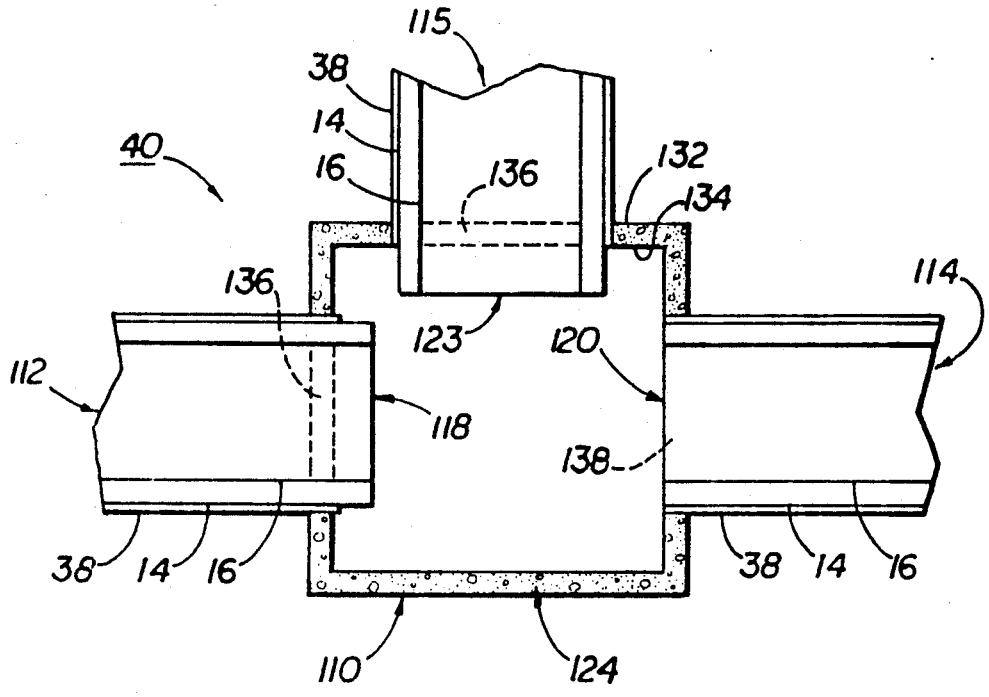
FIGS. 9A–C are cross-sectional and top views of possible arrangements of three multi-walled trenches interconnecting through a container in accord with the present invention.
Figure 9B:
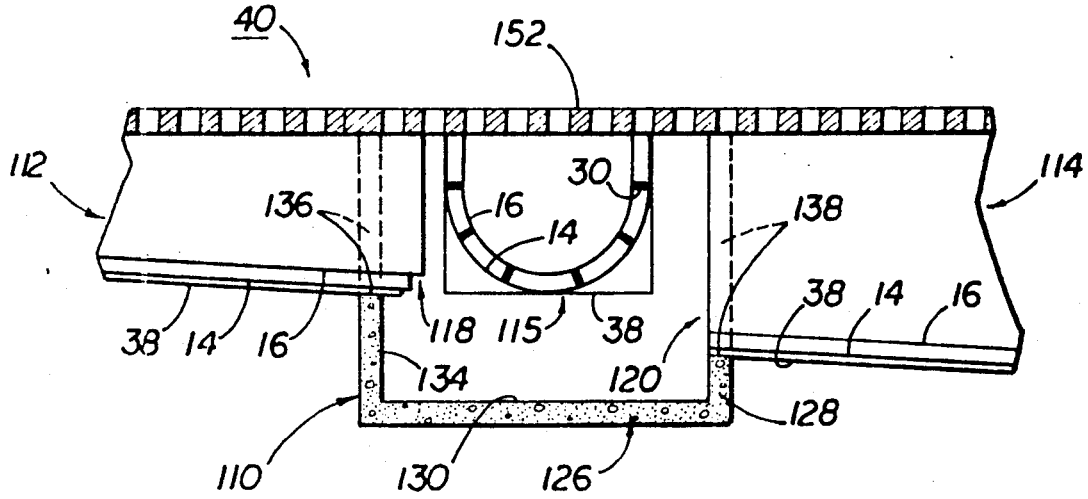
Figure 9C:
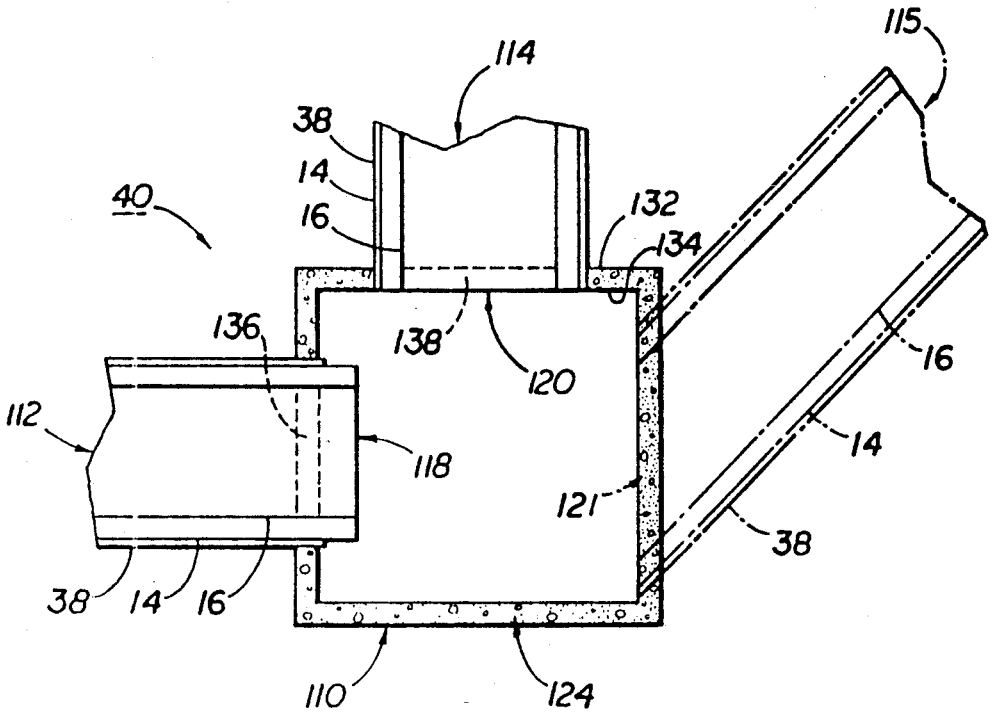
Figure 10:
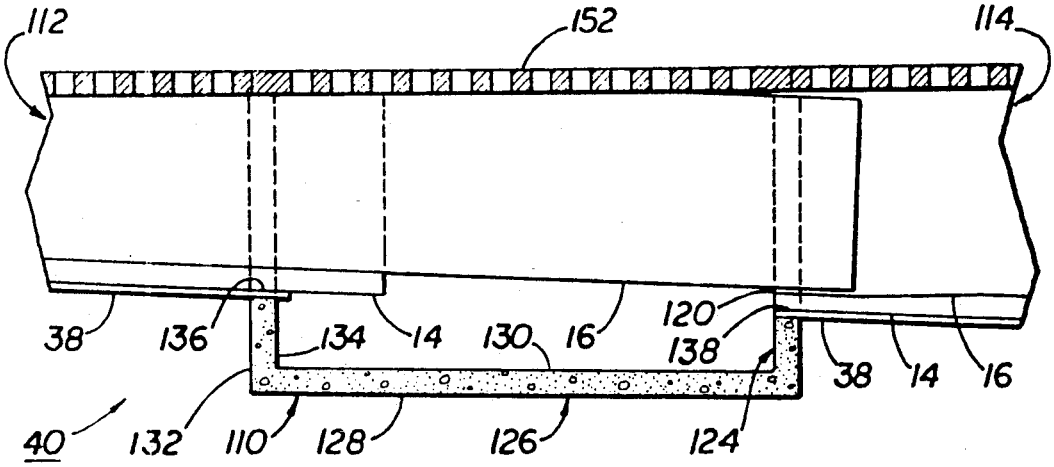
FIG. 10 is a cross-sectional view of a junction box for an expansion joint in accord with the present invention.

Referring to FIGS. 1, 9, and 10, in the multi-walled trench system 40, each multi-walled trench 10 will have a rearward end 116 and a forward end 118, with the rearward end 116 being maintained at a higher elevation than the forward end 118 to permit the unimpeded flow of liquid in the multi-walled trench 10 toward the forward end 118. Referring to FIGS. 9 and 10, if interconnections between multi-walled trenches are needed, the rearward end 120 of a trench 114 is attached to a junction box or container 110, and its forward end (not shown) penetrates but is not attached to a second container (not shown). This is to permit free longitudinal expansion and contraction of the double walled trench 12 inside the holding pan 38. Also to permit flow, when two multi-walled trenches 112, 114 are interconnected at the container 110, the forward end 118 of the first trench 112 will be maintained at a higher elevation where it penetrates the container 110 than the rearward end 120 of the second trench 114 where it is attached to the container 110. With respect to multiple containers 110, the cover or grate 152 on top of of each container 110 will always be level with the surrounding ground, but the depth of each container 110 may vary to permit the flow of liquid from one end of the system 40 to the other.

FIGS. 9 and 10 show the preferred interconnecting system of a container 110 into which two multi-walled trenches 112, 114 (or more) may be positioned. As with the other elements of this invention, the container 110 can be made from any of the materials listed above, and can be cast, formed, or molded in a variety of shapes or sizes as needed. Although the shape of the container 110 shown in FIGS. 9 and 10 is that of a rectangular box, it will be noted that any similar shape will suffice. At least one multi-walled trench 112 will penetrate into the interior of the container 110 at its forward end 118 so that fluid may flow from the forward end 118 into the container 110. Fluid entering container 110 may be discharged through an opening in the bottom or side for external removal. Also, at least one multi-walled trench 114 may be attached to one side of the container 110 at its rearward end 120 so that fluid may flow from the container 110 into the rearward end 120. FIGS. 9A, 9B, and 9C show possible configurations contemplated in the present invention. FIG. 9A shows the plan view of the forward ends 118, 123 of two trenches 112, 115 penetrating a container, with the rearward end 120 of a third trench 114; FIG. 9B shows the cross-section of FIG. 9A; as an alternate configuration, FIG. 9C shows the forward end 118 of one trench 112, the rearward end 120 of a second trench 114 attached perpendicularly to the container sidewall 124, and a phantom view of the rearward end 121 of a third trench 115 attached to the container sidewall 124 at an oblique angle.

Sealing means (not shown) should be employed at the point of contact 138 to force the liquid (not shown) that will accumulate in the container 110 to flow into the inner wall 16 of the outlet trench 114, without permitting any of the liquid to flow either into the holding pan 38 of the outlet trench 114, or into the cavity 28 of the outlet trench 114. For example, a rubber stopper (not shown) molded to fit the trench system 40, could be sealed to the holding pan 38, outer wall 14, and inner wall 16 using a flexible sealant, such as D Aircraft Products - BR 4005.

In addition, as shown in FIGS. 1 and 4, the system 40 may include a plurality of grate-supporting crossbars 140. These horizontal crossbars 140 would be attached to both frame members 46, 48 by suitable attachment means, such as welding the crossbar 140 directly to the outer surface 68 of the depending portion 50 of each frame member 46, 48, or else securing the crossbar 140 to the frame members 46, 48 by a pair of screws 142, as shown in FIG. 4. Each such screw 142 would pass through one of the two crossbar bolt holes (not shown), which are located at each of the two ends of the crossbar 140, and then threadingly attached to one of the two frame members 46, 48 through a threaded hole (not shown) in the horizontal section 50 of each frame member 46, 48.

INSTALLATION AND OPERATION

The installation and operation of the multi-walled trench system 40 is as follows: A channel 42 is dug in the ground deep enough to hold the multi-walled trench system and the concrete surrounding it. Should more than one trench be needed, this channel 42 should be broad enough at each junction to hold a container. In any embodiment, the next major step is assembling the multi-walled trench 10, and if necessary the whole system 40, in the channel 42.

In the preferred embodiment, referring to FIG. 7, an anchor plate 100 will be connected to each collar 94 by a connecting member 97. The bottom surfaces 104 of each of the anchor plates 100 are placed flush against the top surfaces of the flanges 82, so that the flange adjustment slots align with the second bolt holes 108 of the anchor plates 100. A threaded bolt 70 is inserted through each second bolt hole 108 (which may or may not be threaded) and the flange adjustment slot (which is unthreaded), and is temporarily fastened with a corresponding nut 72 below the flanges 82.

Next, the outer wall 14 is placed inside the holding pan 38. Fluid sensors 32 may be placed into the bottom 22 of the outer wall 14 to detect leakage. The inner wall 16 is then placed inside the outer wall 14. A cavity 28 is formed and maintained between the inner wall 16 and the outer wall 14 by means of a plurality of spacing members 30, integrally formed on the outide surface 26 of the inner wall 16. When the inner wall 16 is placed inside the outer wall 14, these spacing members 30 rest against the inside surface 20 of the outer wall 14.

A T-shaped cap 148, which is as wide as the desired cavity 28, is placed between the top edge 34 of the inner wall 16 and the top edge 36 of the outer wall 14. This T-shaped cap 148 should be included to provide additional sealing between the inner wall 16 and the outer wall 14 to prevent liquids seeping into the cavity 28 from under the frame 46, 48.

Once the inner wall 16 and the outer wall 14 are in place, the frame members 46, 48 are placed on the top surface 102 of the anchor plates 100 so that the frame bolt holes 64 are aligned with the threaded first bolt holes 106 in the anchor plate 100. The frames 46, 48 are then secured to the anchor plates 100 by inserting a threaded bolt or screw 74 into each frame bolt hole 64 and threadingly attaching the bolt 74 to the corresponding first bolt hole 106. At this point, the nuts 72 securing the flange 82 to the anchor plate 100 are loosened, but not removed. The flange 82 is then adjusted on the anchor plate 100 so that the inside surface 66 of each frame member 46, 48 pushes the inner wall 16 against the spacing members 30 on the outer wall 14, and thus pushes the outer wall 14 against the holding pan sidewall 76, 78. Once each frame 46, 48 is in place, the nuts 72 are tightened.

In the second embodiment, referring to FIG. 8, the frames 46, 48 will be connected directly to the collar 94 by the connecting member 97. Because of this, both the outer wall 14 and the inner wall 16 must be installed in the holding pan 38 before the holding pan 38 is secured to the anchoring means. Installation of the double walled trench 12 in the holding pan 38 proceeds primarily as in the preferred embodiment.

Once the inner wall 16 and the outer wall 14 are in place within the holding pan 38, the bolts 73 in the frame member 46, 48 are aligned with the adjustment slots in the flanges 82 so that the inner surface 66 of each frame member 46, 48 pushes the inner wall 16 against the spacing members 30 on the outer wall 14, and thus pushes the outer wall 14 against the holding pan sidewalls 76, 78. The frame members 46, 48 are then attached to the flanges 82 by inserting a threaded bolt 70 through each of the frame bolt holes 64 and flange adjustment slots and securing the bolt 70 with a nut 72 below the flanges 82.

In any embodiment, if multiple trenches are needed, the rearward end of each trench 120 may be attached to a container 110. If necessary at this time, the rearward end 121 of additional outlet trenches 115 can also be attached to that container, as in FIG. 9C. The sealing means is employed at the point inside the container where the rearward end 120 contacts 138 the container, in order to force liquid that will accumulate in the container 110 to flow into the inner wall 16 of the outlet trench 114. Next, the forward end 118 of the inlet trench 112 is inserted into the container 110. Flexible sealing means should be used to fix the inlet trench at the point 136 where it contacts the container 110. If necessary at this time, the forward end 123 of additional inlet trenches 115 may be inserted likewise into that container 110, as shown in FIGS. 9A and 9B.

Referring to FIG. 10, if a simple joint between two multi-walled trenches 10 is needed, the rearward end 120 of the outlet trench 114 is attached to a container 110 as in the interconnection described above. Next, the inlet trench 112 is inserted into the container 110 so that the inner wall 16 of the inlet trench 112 (which is longer than the outer wall 14 of that trench 112) is placed within the inner wall 16 of the outlet trench 114. This permits the uninterrupted flow of liquids directly from the inlet trench 112 to the outlet trench 114; it also permits the liquids that have leaked from the inner wall 16 to the outer wall 14 to flow into the container 110, where the liquid can be visually detected by a person looking through the grate 152 over the container 110.

Once the multi-walled trench 10 (or trench system 40) has been assembled in the channel 42, it is arranged in the channel 42 along its ultimate path, is raised approximately to its finished grade, and supported at that grade by supporting members (not shown) such as a set of two-by-fours. A plurality of supporting rods 92 are placed at regular intervals into the ground, one through each collar 94. Once the supporting rods 92 are secure, the trench 10 is adjusted to the finished grade, and is tightly fastened to the supporting rods 92 by L-bolts 98 through the threaded bores 96 in the collars 94. The supporting members are removed before the concrete 150 surrounding the trench 10 is poured.

When the trench 10, or if applicable the system 40, is complete and in place, concrete 150 is poured around it, until the level of the concrete 150 reaches the top of each of the frames 46, 48. Finally, a cover or grate 152 is placed on each multi-walled trench 10, and a cover or grate 152 is placed on each container 110.

What is claimed is:

1. A multi-walled trench comprising:

a. an outer wall having an inside surface and an outside surface;

b. an inner member having an open top for receiving fluid along its length disposed within the outer wall and having an inside surface and an outside surface, a cavity being formed between the inside surface of the outer wall and the outside surface of the inner member; and c. means in the cavity for maintaining a space between the inner member and outer wall to allow the expansion and contraction of the inner member and outer wall relative to each other and to allow fluid escaping from the inner member to gravitate to a low point for sensing or visual inspection.

2. A system for forming a multi-walled trench comprising:

a. a pair of frame members each having a horizontal section and a section depending from the horizontal section;

b. a holding pan having sidewalls exterior to the depending portion of the frame members, a bottom floor disposed between the sidewalls, and flanges on each sidewall extending parallel to the plane of the horizontal section of the frame member and away from the depending portion;

c. an outer wall disposed within the holding pan having an inside surface and an outside surface, the outside surface of the outer wall engaging at least a portion of the sidewalls and the bottom walls of the holding pan;

d. an inner wall disposed within the outer wall having an inside surface and an outside surface, the inside surface of the inner wall engaging at least a portion of the inner surface of the depending portion of the frame members, and a cavity being formed between the outside surface of the inner wall and the inside surface of the outer wall;

e. means in the cavity for separating the inner wall from the outer wall to allow the expansion and contraction of each wall relative to the other and to allow fluid escaping from the inner wall to gravitate to a low point for sensing or visual inspection;

f. means for adjustably securing each frame member to a respective one of the flanges on a sidewall whereby the inner and outer walls are maintained in their desired locations within the pan; and g. adjustable anchoring means attached to the frame members for providing vertical adjustment of the frame members relative to the ground and to each other.

3. The system of claim 2, wherein the adjustable anchoring means comprises an anchor plate interposed between the horizontal section and the flange whereby the horizontal section is detachably secured to the anchor plate so that a selected one or more of the frame members, the inner wall, and the outer wall may be replaced after installation of the system.

4. The system of claim 3, wherein the adjustable anchoring means further comprise:

a. a supporting rod capable of being securely anchored to the ground;

b. a collar having an opening along its length which receives therethrough the supporting rod;

c. means for securing the collar to the frame; and d. means for adjustably securing the collar to a selected position on the rod.

5. The system of claim 2, and further comprising means for interconnecting one multi-walled trench to one or more additional multi-walled trenches to permit changing the direction of liquid flow in the multi-walled trenches relative to each other and changing the slope of the multi-walled trenches relative to the ground.

6. The system of claim 5, wherein each multi-walled trench has a forward end and an opposite rearward end, the forward end being lower in elevation than the rearward end to permit the regular flow of liquid in the multi-walled trench toward the forward end.

7. The system of claim 6, wherein the interconnecting means comprises a container having a bottom surface and an upstanding sidewall joined to the edge of the bottom surface.

8. The system of claim 7, and further comprising the rearward end of a multi-walled trench being fixed to and in communication with the sidewall of the container, and the forward end of another multi-walled trench extending through the sidewall and into the interior of the container.

9. The system of claim 7, wherein each multi-walled trench extends between two containers, the container designated for receiving fluids being deeper than the other, with the forward end of the trench being received through the sidewall of the deeper container and the rearward end of the trench being fixed in the sidewall of the shallower container.

10. A trench system for use within a trench, comprising:

a. a trench wall containing means within the trench;

b. an outer wall disposed within the wall containing means;

c. an inner wall disposed within the outer wall and having an open top for receiving fluid along its length;

d. means for spacing the inner wall from the outer wall so as to form a cavity therebetween;

e. means for supporting the trench wall containing means within the trench; and f. means on the supporting means for maintaining the inner and outer walls within the trench wall containing means to allow independent expansion and contraction of each of the walls.

11. A trench system, comprising;

a. a trench wall containing means;

b. an outer wall;

c. an inner wall disposed within the outer wall;

d. means for spacing the inner wall from the outer wall, so as to form a cavity therebetween;

e. means for supporting the trench wall containing means within a trench;

f. means on the supporting means for maintaining the inner and outer walls within the trench wall containing means to allow independent expansion and contraction of each of the walls; and wherein the trench wall containing means comprises a rigid elongated channel-shaped member having a bottom and opposed sides extending longitudinally from the edges of the bottom, and wherein the outer and inner walls are elongated, rectangular or U-shaped conduits, each wall having an interior and an exterior surface and an open top, the outer surface of the outer wall engaging the bottom sides of the channel-shaped member.

12. The trench system of claim 11, wherein the spacing means are within the cavity and comprise a plurality of rigid elements spaced within the cavity, each element having one end connected to the outside surface of the inner wall and the opposite end of each element being in engagement with the inside surface of the outer wall.

13. The trench system of claim 11, wherein the supporting means comprises a plurality of rods spaced along and on each side of the trench wall containing means, and collar means moveable on the rods.

14. The trench system of claim 13, wherein the maintaining means comprises flanges laterally projecting from the top of the sides of the containing means and wherein the maintaining means comprises a horizontal section having a length greater than the length of the flange and having a forward end and a section depending from the forward end of the horizontal section, the inner side of the depending section in engagement with the inner surface of the inner wall and means for adjustably securing the bottom surface of the horizontal section to the top surface of the flange, whereby the inner side of the depending section is moved against the inner surface of the inner wall until the inner surface of the outer wall engages the rigid elements, whereby the horizontal section and the flange are secured together.

15. The trench system of claim 11, and further comprising means for covering the cavity about the top of the inner and outer walls.

16. The trench system of claim 10, and further comprising a fluid detecting means in the cavity.

17. A system for use within a trench, comprising:

a. an outer wall disposed within the trench;

b. an inner wall located within the outer wall and having an open top for receiving fluid along its length, the outer wall and the inner wall forming a space therebetween; and c. means on the outer wall for supporting the inner wall within the outer wall to allow movement of the inner wall independent of any movement of the outer wall.

* * * * *